United States Patent [19]

Jacobs

[11] Patent Number: 4,633,740

[45] Date of Patent: Jan. 6, 1987

[54] COMBINATION RECEPTACLE OPENER

[75] Inventor: Ralph S. Jacobs, Norton, Mass.

[73] Assignee: Color Dynamics, Inc., Norton, Mass.

[21] Appl. No.: 663,767

[22] Filed: Oct. 23, 1984

[51] Int. Cl.[4] ..... B67B 7/44

[52] U.S. Cl. ..... 81/3.09; 81/3.4; 81/3.55; 7/151; 7/901

[58] Field of Search ..... 81/3.09, 3.07, 3.4, 81/3.55, 3.57; 7/151, 901

[56] References Cited

U.S. PATENT DOCUMENTS

| | | | |
|---|---|---|---|
| D. 238,411 | 1/1976 | Levenson | 81/3.55 |
| 1,661,333 | 3/1928 | Gurnett | 81/3.09 |
| 2,856,804 | 10/1958 | Whiteley | 81/3.4 |
| 3,570,028 | 3/1971 | De La Hitte | 81/3.57 |
| 3,730,026 | 5/1973 | Matsumoto | 81/3.57 |
| 3,812,741 | 5/1974 | Heine | 7/151 |
| 4,253,352 | 3/1981 | O'Neal | 81/3.55 |
| 4,309,921 | 1/1982 | Miller | 81/3.55 |
| 4,373,223 | 2/1983 | Miller | 81/3.09 |
| 4,409,863 | 10/1983 | Anderson | 81/3.09 |
| 4,412,464 | 11/1983 | Cook | 81/3.09 |
| 4,414,865 | 11/1983 | Brooks et al. | 81/3.09 |
| 4,433,597 | 2/1984 | Rowland | 81/3.09 |
| 4,474,087 | 10/1984 | Widman | 81/3.55 |

FOREIGN PATENT DOCUMENTS

| | | | |
|---|---|---|---|
| 2221942 | 10/1974 | France . | |
| 44336 | 10/1938 | Netherlands | 81/3.4 |
| 517142 | 1/1922 | United Kingdom | 81/3.4 |
| 2096111 | 10/1982 | United Kingdom | 81/3.4 |

*Primary Examiner*—Roscoe V. Parker

*Attorney, Agent, or Firm*—Bromberg, Sunstein & McGregor

[57] ABSTRACT

A combination receptacle opener including a plate member having at least one aperture with serrations for gripping for twisting off a twist-cap inserted into the aperture. The aperture also includes a segment for engagement beneath the lip of a crown cap for prying the cap off its bottle, this second function being performed from the same face of the plate member as the twisting function. Further embodiments include tang members extending from one face of the plate member around an aperture, which serve as insertion depth regulations for twist-cap inserted into the aperture, and a baffle extending from one face of the opener around an aperture for adjusting the operative diameter of the aperture for use with smaller twist-caps.

18 Claims, 15 Drawing Figures

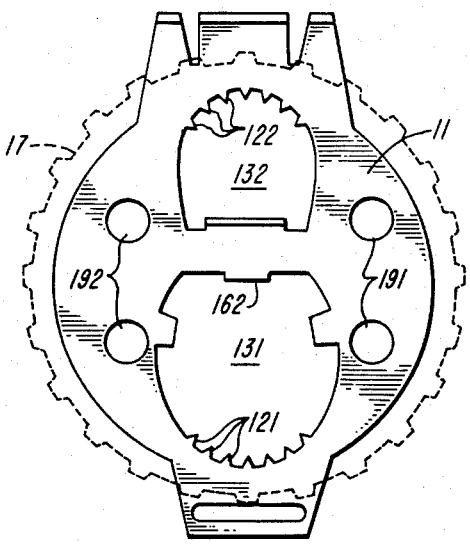
FIG. 2A
FIG. 3
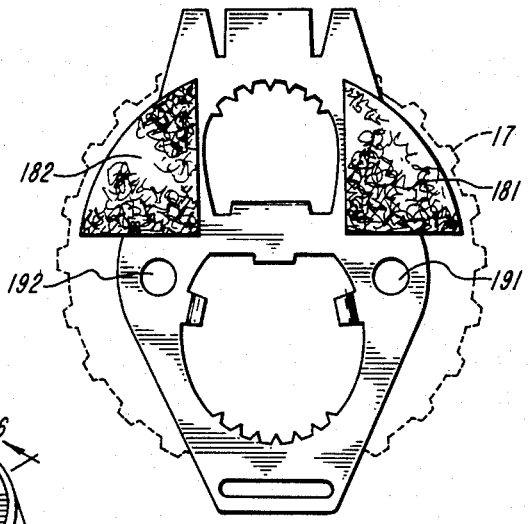
FIG. 4
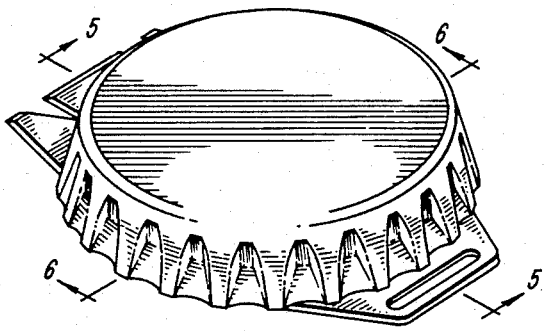
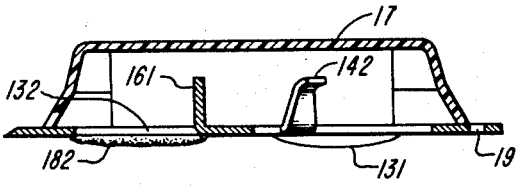
FIG. 5
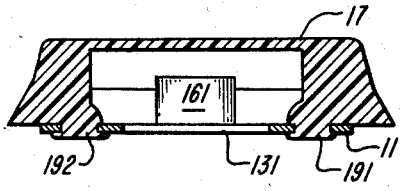
FIG. 6

COMBINATION RECEPTACLE OPENER

DESCRIPTION

Technical Field

This invention relates to a combination receptacle opener, for use with containers having twist-off caps of various shapes and sizes, pry-off caps, and cans with lift-tabs.

BACKGROUND OF THE INVENTION

Many modern beverage containers, e.g. for soda, beer, juice and cordials, as well as pharmaceutical, toiletry and other household items, are bottles with twist- and pry-off caps, or cans with lift-tabs. Consumers open such containers using a variety of tools ranging from the common pry-off cap openers, to more recent types of openers developed for twist-off caps, which commonly feature recesses for engaging the caps' outer surfaces, as in U.S. Pat. No. 3,812,741. For the lift-tabs of cans, tools are available with sockets for receiving these tabs, as in U.S. Pat. Nos. 4,412,464; 4,253,352; 4,373,223; 4,409,863; and 4,309,921. The wisdom of using such openers for removing not only pry type crown caps, but twist-off caps and the lift-tabs on cans as well, has long been recognized for avoiding injury to hands and fingers which can be occasioned by stubborn caps, often with jagged metal edges. Also, it has been appreciated that the added force such tools bring to bear in the re-closing of twist caps creates a tighter seal, thereby prolonging the life of their contents, carbonated beverages in particular.

Previous inventors have recognized the advantage of combining some of these functions in one tool, for example, U.S. Pat. No. 4,414,865 which has both the twist-off and lift-tab opener features described above. Another combination tool is found in U.S. Pat. No. Des. 238,411, combining twist-off and pry-off functions. Similarly, U.S. Pat. No. 4,433,597 is a combination bottle cap opener for prying or twisting off crown caps, however without means for opening non-crown type twist-off caps, nor a feature for the stay-on tabs of cans.

While some inventors have further recognized the commercial market (e.g. airlines, bars and restaurants) for a combination opener in addition to its individual consumer market, none have developed a feature for opening the smaller, individual cordial bottles widely provided by such establishments. Since the caps on these bottles are too small for the more standard recesses of the openers disclosed above, flight attendants and other beverage service personnel are relegated to opening these bottles with their hands. This inconvenience is made worse by the fact that individual cordial bottles are inherently more difficult to grip because of their diminutive size. Furthermore, these smaller beverage bottle caps have size equivalents in many other household products, e.g. certain toiletries, pharmaceuticals and grocery items. The "decapping tool" disclosed in U.S. Pat. No. 1,841,270 to Aeschbach et al. includes a centrally apertured, generally V-shaped frame having straight, converging inner edges with saw-toothed projections, the converging edges defining an aperture which can accommodate jars of various sizes when inserted at the appropriate point within the V-shaped aperture. The tool is to be mounted to a wall or counter for stationery use relative to the containers it is opening, and appears to be designed for twist-caps ranging in size from those on ketchup bottles to those on "wide-mouth" jars. Even at its most convergent point, however, it does not appear to fit twist-caps of individual cordial bottle size; it is more designed for permanent kitchen use than for toting and opening receptacles anywhere.

French Pat. No. 2,221,942 issued to Rossler discloses a hand-held bottle opener having a generally flat, V-shaped frame which surrounds a flat, recessed core (i.e., the core is flush with the frame from one face of the opener, recessed from the other). This core also ludes a generally trapezoidal cutout extending between the arms of the "V" at roughly the mid-section of the opener, the parallel sides of such opening being designed for prying tapered crown caps off individual beverage bottles in the conventional manner, viz., one parallel edge pries from beneath the lip of the cap, while the opposite side applies opposite pressure at the cap's top. This function is performed from the flush face of the opener only, while the twist-off function can be performed only from the recessed face, requiring a 180 degree flip between functions.

For the twist-off function of the Rossler patent, one of the non-parallel sides of the trapezoidal cutout is formed with serrations. Twist-caps are to be inserted into the recessed face anywhere along this serrated segment, and the opener rotated clockwise on the cap for removal. But while twist-caps of more than one size can be accommodated within the convergent frame (much as in the Aeschbach patent described above), the range of sizes actually accommodated is even more limited than in the Aeschbach patent. The range in the Rossler patent is dependent upon the length of the serrated segment along one inner edge of the "V", which is also the width (i.e., non-parallel side) of the trapezoidal cutout. This dimension, however, must always be smaller than the diameter of the average crown bottle cap in order for the pry-off function to work. Thus, the range of caps accommodated is relatively limited, and in any event the opener would not appear to work with cordial-sized caps.

DISCLOSURE OF THE INVENTION

The combination receptacle opener of the present invention includes a plate member having at least one aperture with serrations for gripping for twisting off a twist-cap inserted into the aperture. An aperture also includes a segment for engagement beneath the lip of a crown cap for prying the cap off its bottle, this function being performed from the same face of the plate member as the twisting function. Further preferred embodiments include tang members extending from one face of the plate member around the aperture which serve as an insertion depth regulator to an inserted twist-cap, and a baffle extending from one face of the opener around the aperture for adjusting the operative diameter of the aperture for use with smaller twist-caps, as discussed in detail below. The baffle feature represents a further improvement over the prior art in that twist-caps of various sizes are accommodated, not solely along the plane of the opener between convergent edges, but along an infinite number of planes within an aperture, through the use of a baffle on the edge of the aperture and an opposing serrated edge. Both the twisting and prying functions allow insertion of container caps into the same face of the plate member of the opener, thereby freeing up the opposite, non-insertion face of the plate member to carry a decorative housing that may further serve as a protective cap to the tangs and baffle, and as a gripping handle for the opener. These and other features of the present invention will be more clearly understood by the following description taken with the accompanying drawings.

BRIEF DESCRIPTION OF THE DRAWINGS

FIG. 2A is a perspective view of an alternative configuration of the main plate member of the embodiment of FIG. 1.

FIG. 3 is a view of the embodiment similar to that of FIG. 2, but showing the hanging material in place.

FIG. 4 is a perspective view of the embodiment.

FIG. 5 is a cross-sectional view through line 5—5 of FIG. 4.

FIG. 6 is a cross-sectional view through lines 6—6 of FIG. 4.

DESCRIPTION OF PREFERRED EMBODIMENT

Figure 1:
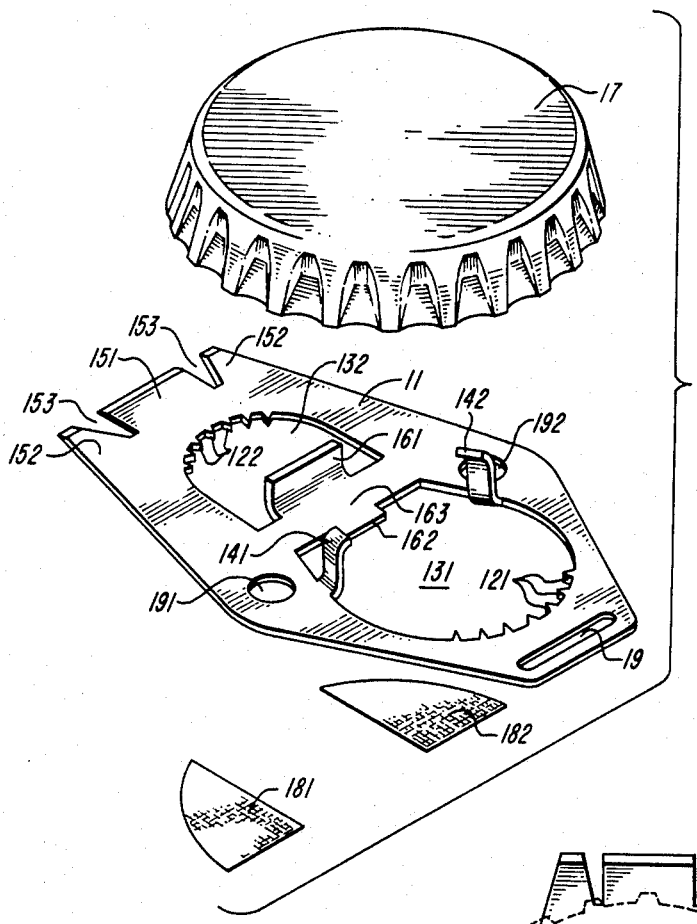
FIG. 1 is an exploded view of a preferred embodiment of the invention, separately showing the decorative housing, main plate member and patches of hanging material.

FIG. 1 is an exploded view of a preferred embodiment of the invention, separately showing three material components: plate 11, stamped from a suitable metal; housing 17, molded out of a suitably durable synthetic material capable of being imprinted; and patches of hanging material 181 and 182, here shown as hook material for mating with pile material. As will be seen below in connection with FIGS. 2 and 3, housing 17 is mounted to plate 11 through attachment holes 191 and 192, and material patches 181 and 182 are adhesively attached along the underside of the opener to plate 11 and housing 17. (Throughout this description, a number used to identify a feature appearing in a given Figure will uniformly identify the same feature in any subsequent Figure.) Plate 11 includes primary aperture 131 and secondary aperture 132, both roughly U-shaped with generally straight sides connected by bar 163. Serrated portions 121 and 122 are located along the arcuate segments of apertures 131 and 132, respectively, each for gripping the ribbed surfaces of a twist-cap. Primary aperture 131 further has a generally straight edge with lip 162 for prying off a tapered crown cap from a bottle. Baffle 161, whose function is explained below, extends roughly perpendicularly from the straight side of secondary aperture 132. Similarly, tangs 141 and 142 are situated on opposing sides of primary aperture 131 and are inwardly inclined at their ends to act either individually or together as a limit-stop to an inserted twist-cap, as detailed further below.

FIG. 1 additionally shows, along the periphery plate 11, a straight, bevelled edge with 2 decorative notches 153 that together create, as well as separate, central foot 151 and side supports 152.

Figure 2:
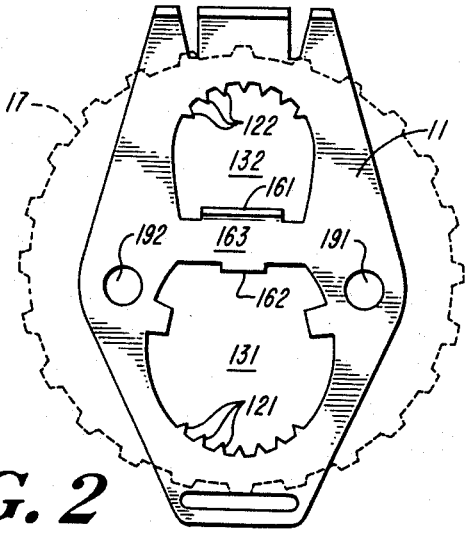
FIG. 2 is an underside view of the embodiment of FIG. 1, without hanging material.

FIGS. 2 and 3 are underside views of the embodiment of FIG. 1, as assembled. The underside of plate 11 shown in FIGS. 2 and 3 will be referred to alternatively throughout this specification, and exclusively in the claims, as the "insertion face", for reasons which will become clear in the below discussion regarding operation of the embodiment. Similarly, the top side of plate 11 shown in the exploded view of FIG. 1 will be referred to as the "non-insertion face".

FIG. 2 shows plate 11 and housing 17 (in phantom), which may be attached through attachment holes 191 and 192 by various means well known in the art. FIG. 2A shows an alternative configuration of plate 11, said plate generally widened at the mid-portion to match the contours of housing 17 at the points where said housing would otherwise overhang plate 11. In FIG. 3, patches of hanging material 181 and 182 are shown, adhesively attached to the insertion face of plate 11 and the underside of housing 17. Preferably they are pile material to be used with a mating patch of hook material that can be sold with the opener for attaching to an appropriate storage surface. Alternatively, the hook and pile system can be replaced with magnets for storing the opener on metal surfaces.

FIG. 4 is a perspective view of the embodiment of FIG. 1, as seen from above. FIG. 5 is a longitudinal cross-sectional view taken through axis 5—5 of FIG. 4, revealing tang 142 and baffle 161 encased within the hollow of housing 17. FIG. 6 is a latitudial cross-sectional view taken through axis 6—6 of FIG. 4, revealing the broadside of baffle 161 as encased within housing 17, and picturing housing 17 as mounted to plate 11 through attachment holes 191 and 192.

Figure 7:
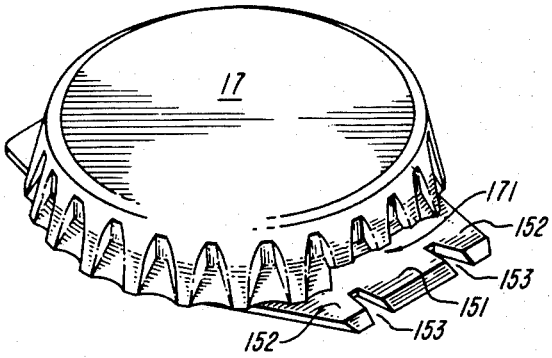
FIG. 7 is a perspective view of the embodiment similar to FIG. 4, but from the opposite end.

FIG. 7 is a perspective view of the opener similar to that of FIG. 4, but inverted so as to bring the bevelled edges 151 and 152 of plate 11 into view, with the slotted end now out of sight. This end of plate 11 includes two notches 153 that separate central bar 151 from side supports 152, all three of these structures formed with flat bevelled edges as shown. Also at this side of the opener, housing 17 is apertured to form window 171, generally above and aligned with central bar 151.

Figure 9:
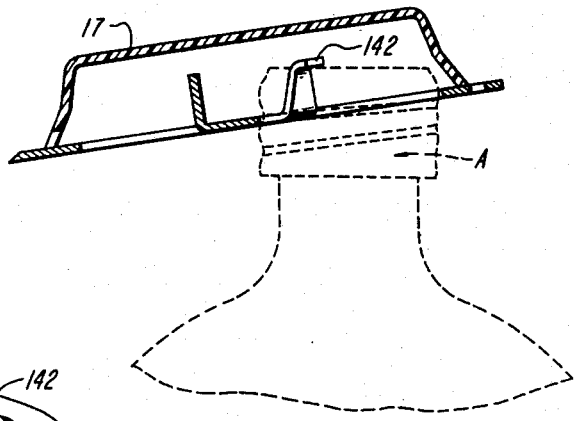
FIG. 9 is a cross-sectional view of the embodiment as it is used to remove a standard size twist-cap.
Figure 8:
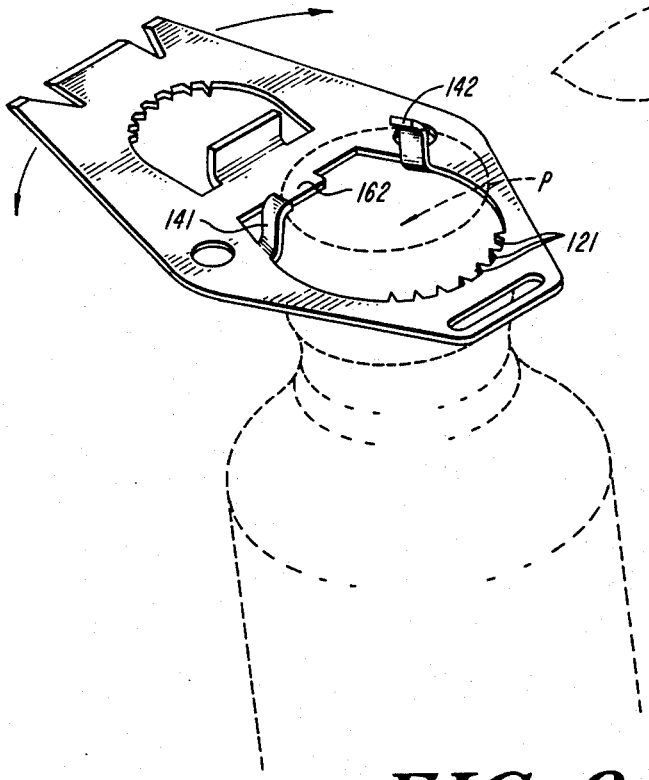
FIG. 8 is a view of the main plate of the embodiment as it is used to remove a large twist-cap.

FIG. 8 illustrates the manner in which the embodiment may be used to remove a twist-cap (housing 17 is removed for clarity). Plate 11 is lowered over a bottle with twist-cap P so as to insert the cap P into primary aperture 131 until the cap makes contact with the ends of tangs 141 and 142, thus bringing the sides of cap P into firm contact with serrations 121. In this position, the opener is then rotated clockwise to release the cap. As some beverages have recently been marketed in multi-liter bottles with plastic twist-caps that are larger than the more common aluminum twist-caps, primary aperture 131 has been made wide enough to accommodate these larger caps, as pictured in FIG. 8. Therefore, the somewhat smaller, though more common aluminum twist-caps are best gripped in aperture 131 when inserted at a slight angle (i.e., with the plane of the top of the cap at an angle relative to the plane of the plate member of the opener), as shown in FIG. 9, bringing the top of such a cap into oblique contact with either one or both of tangs 141 and 142, and forcing a side of the cap firmly up against serrations 121 for effective gripping and rotation. A counter-clockwise motion is used to re-cap these containers. The same motion is used for opening twist-type crown caps, found frequently on beer bottles, though without inserting these relatively shallow caps down to the ends of tangs 141 and 142.

Figure 11:
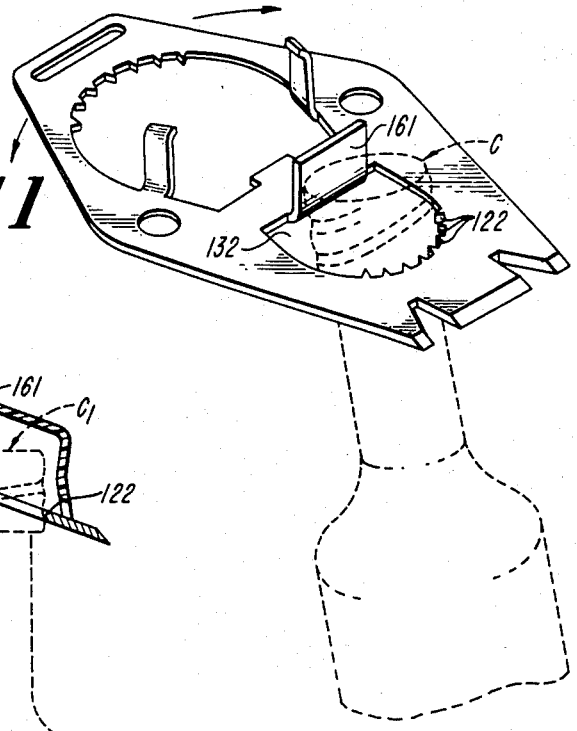
FIG. 11 is a cross-sectional view of the embodiment as it is used to remove a standard size individual cordial bottle cap.
Figure 10:
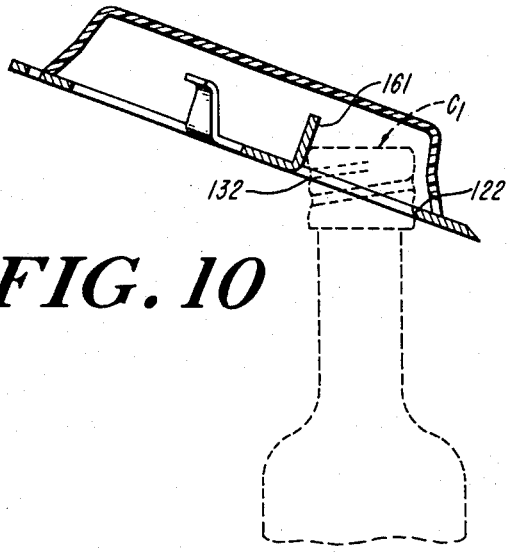
FIG. 10 is a view of the main plate of the embodiment as it is used to remove a large size cordial bottle cap.

Pictured in FIGS. 10 and 11, individual cordial bottles and other containers with twist-caps of that generally smaller size are opened in secondary aperture 132 much the same way as larger twist caps in primary aperture 131. As with the larger caps discussed above, cordial bottle caps are currently available in two different sizes, such that secondary aperture 132 is contoured to fit the larger of these, shown in FIG. 10, and baffle 161 is provided to modify aperture 132 to accommodate the smaller of these caps at an angle, as shown in FIG. 11. Specifically, since the smaller caps are too narrow to fit snugly against serrations 122 when inserted flatly into (i.e., along parallel planes with) aperture 132, such caps are instead angled into aperture 132 so that one side of the cap meets baffle 161, while another edge firmly meets serrations 122, thus allowing for adequate gripping and effective rotation.

Figure 12:
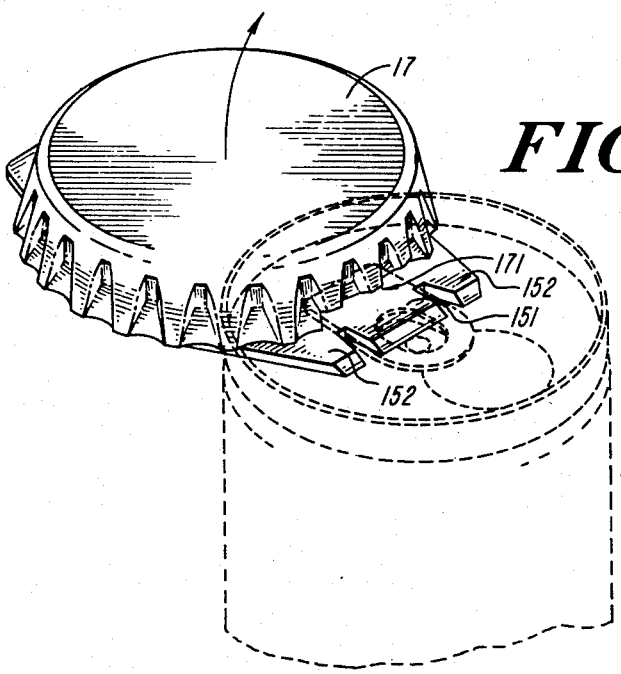
FIG. 12 is a view of the embodiment as it is used to open a lift-tab on a can.

To open cans with lift-tabs, as pictured in FIG. 12, foot 151 is inserted beneath the lift-tab mechanism while side supports 152 rest on either side of the mechanism on the can top, and steady the opener in position during this function. The proximal, free end of the lift-tab is simultaneously introduced through window 171 of housing 17. Once in position, the opener is pivoted forward, causing foot 151 to place upward pressure on the free-end of the tab, which in turn causes the distal, secured end of the tab to depress the scored section of the can top.

Figure 14:
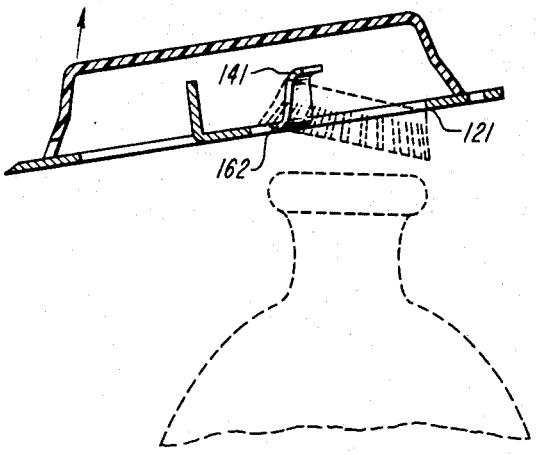
FIG. 14 is a cross-sectional view of the embodiment as it is used to pry off a crown cap from a bottle.
Figure 13:
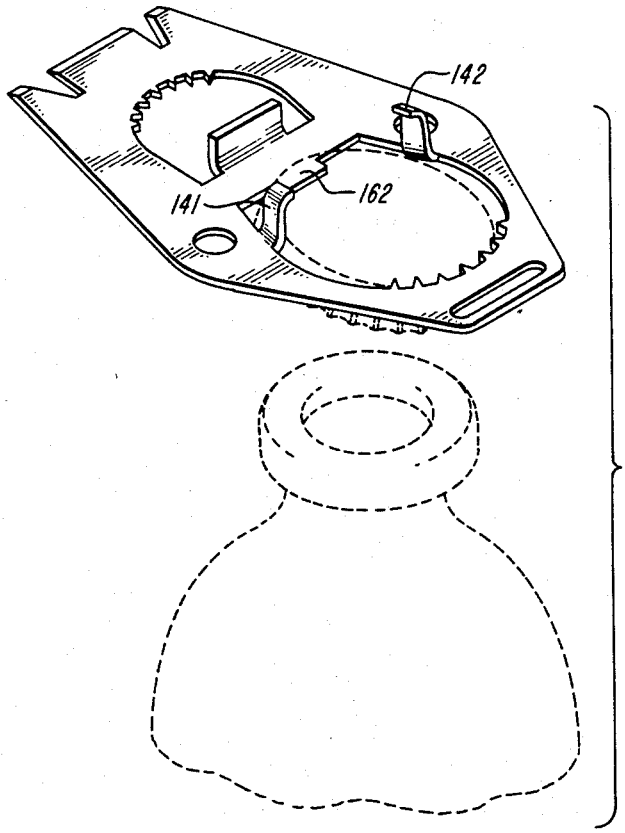
FIG. 13 is a view of the main plate of the embodiment as it is used to pry off a crown cap from a bottle.

To pry a crown cap from a bottle, as shown in FIGS. 13 and 14, lip 162 is placed beneath the rim of such a cap, and the opener is then pivoted forward.

A further embodiment of the invention envisions primary aperture 131 without tangs 141 and 142, where the underside of housing 17 is at an appropriate height to serve as cap insertion-depth regulator. However, it should be noted that tangs 141 and 142 and baffle 161 of the pictured embodiment are all concealed within housing 17, presenting no protrusions to the hand during use.

Additionally, housing 17 can be of virtually any shape, although the nubby edges shown in the illustrated embodiment are used to facilitate gripping. Aside from serving as a handle, a protective cap and a socket for receiving lift-tabs, the housing may also be used as an advertising or other decorative medium.

It should be understood that the foregoing represent merely exemplary embodiments of the present invention and that various changes and modifications can be made in the arrangements and details of construction of the elements described and shown above without departing from the spirit and scope of the invention.

What is claimed is:

1. A combination receptacle opener, comprising:

a plate member having two faces and an aperture, wherein a portion of the inner surface of the plate member surrounding the aperture includes serrations for gripping for twisting off a twist-cap inserted flatly into the aperture (i.e., in such a way that the plane of the top of the cap is parallel to the plane of the plate member), and a further portion of such inner surface includes means for engaging a crown cap such that the serrated portion of such inner surface serves as a fulcrum for prying such a cap off its bottle, wherein in each case, the twist-cap or the crown cap is first inserted into the same face of the plate member (hereinafter the "insertion face") for removal.

2. An opener according to claim 1, further comprising at least one tang member extending from the non-insertion face of the plate member at a site along the surface surrounding the aperture, such tang being positioned so as to define a limit for the insertion depth of a twist-cap inserted into the aperture, such limit allowing the serrations to continue to grip the twist-cap when the cap is inserted to the limit.

3. A combination receptacle opener, comprising:

a plate member having two faces and an aperture, wherein a portion of the inner surface of the plate member surrounding the aperture includes serrations for gripping for twisting off a twist-cap inserted flatly into the aperture (i.e., in such a way that the plane of the top of the cap is parallel to the plane of the plate member), and a further portion of such inner surface includes means for engagement beneath the lip of a crown cap for prying such a cap off its bottle, wherein in each case, the twist-cap or the crown cap is first inserted into the same face of the plate member (hereinafter the "insertion face") for removal; and a baffle member extending from the non-insertion face of the plate member at a site along the surface surrounding the aperture, such baffle so positioned that when a twist-cap of a certain size (i.e., having a diameter too small to allow frictional contact with the serrations when inserted so that the plane of the top of the cap is parallel to the plane of the plate member) is inserted into the aperture in such a way fhat the plane of the top of the cap is at an angle relative to the plane of the plate member, the baffle will be met by the cap at an oblique angle and thus cause a portion of the side of the cap to be toothedly engaged by the serrations for effective gripping for twisting off the twist-cap.

4. A combination receptacle opener, comprising:

a plate member having two faces and an aperture, wherein a portion of the inner surface of the plate member surrounding the aperture includes serrations for gripping for twisting off a twist-cap inserted flatly into the aperture (i.e., in such a way that the plane of the top of the cap is parallel to the plane of the plate member), and a further portion of such inner surface includes means for engagement beneath the lip of a crown cap for prying such a cap off its bottle, wherein in each case, the twist-cap or the crown cap is first inserted into the same face of the plate memeber (hereinafter the "insertion face") for removal; and at least one tang member extending from the non-insertion face of the plate member at a site along the surface surrounding the aperture, such tang member being positioned so as to (i) define a limit for the insertion depth of a twist-cap inserted into the aperture, such limit allowing the serrations to continue to grip the twist-cap when the cap is inserted to the limit, and (ii) act as a baffle, such that when a twist-cap of a certain size (i.e., having a diamter too small to allow frictional contact with the serrations when inserted so that the plane of the top of the cap is parallel to the plane of the plate member) is inserted into the aperture in such a way that the plane of the top of the cap is at an angle relative to the plane of the plate member, the baffle will be met by the cap at an oblique angle and thus cause a portion of the side of the cap to be toothedly engaged by the serrations for effective gripping for twisting off of the twist-cap.

5. An opener according to claim 1, wherein a portion of the inner surface surrounding the aperture is a relatively straight segment.

6. An opener according to claim 1, further comprising a decorative housing mounted on the non-insertion face of the plate member, such housing being generally centrally positioned along the length of the plate member and so configured to serve as a gripping handle for the opener during use.

7. An opener according to claim 2, further comprising a decorative housing mounted on the non-insertion face of the plate member so as to enclose the tang member protruding therefrom.

8. An opener according to claim 7, whereby the decorative housing is generally centrally positioned along the length of the plate member and so configured to serve as a gripping handle for the opener during use.

9. An opener according to claim 3, further comprising a decorative housing mounted to the non-insertion face of the plate member so as to enclose the baffle member protruding therefrom.

10. An opener according to claim 9, whereby the decorative housing is generally centrally positioned along the plate member and so configured to serve as a gripping handle for the opener during use.

11. A combination receptacle opener, comprising:

a plate member having two faces and an aperture, wherein at least a portion of the inner surface of the plate member surrounding the aperture includes serrations for gripping for twisting off a twist-cap that is inserted flatly (i.e., such that the plane of the top of the cap is parallel to the plane of the plate member) into the aperture from the insertion face of the plate member; and a baffle member extending from the non-insertion face of the plate member at a site along the surface surrounding the aperture, such baffle member so positioned that when a twist-cap of a certain size (i.e., having a diameter too small to allow frictional contact with the serrations when inserted so that the plane of the top of the cap is parallel to the plane of the plate member) is inserted into the aperture in such a way that the plane of the top of the cap is at an angle relative to the plane of the plate member, the baffle will be met by the cap at an oblique angle and thus cause a portion of the side of the cap to be toothedly engaged by the serrations for effective gripping for twisting off of the twist-cap.

12. An opener according to claim 11, further comprising a decorative housing mounted on the non-insertion face of the plate member so as to enclose the baffle protruding therefrom.

13. An opener according to claim 12, wherein said housing is centrally positioned along the length of the plate member and configured so as to serve as a gripping handle for the opener during use.

14. An opener according to claim 11, wherein the aperture is proportioned to accommodate twist-caps generally of the size found on individual cordial bottles.

15. An opener according to claim 11, wherein a portion of the inner surface surrounding the aperture is a relatively straight segment.

16. A combination receptacle opener, comprising:

a plate member having two faces, comprising:

(a) first and second aperture arrangements, each including:

an aperture, wherein at least a portion of the inner surface of the plate member surrounding the aperture includes serrations for gripping for twisting off a twist-cap that is inserted into the aperture from the insertion face of the plate member;

at least one baffle member extending from the non-insertion face of the plate member at a site along the surface surrounding the aperture, such that when a twist-cap of a certain size (i.e., having a diameter too small to allow frictional contact with the serrations when inserted so that the plane of the top of the cap is parallel to the plane of the plate member) is inserted into the aperture in such a way that the plane of the top of the cap is at an angle relative to the plane of the plate member, the baffle will be met by the cap at an oblique angle and thus cause a portion of the side of the cap to be toothedly engaged with the serrations for effective gripping for twisting off of the cap; and a relatively straight segment along one portion of the inner surface surrounding the aperture;

wherein the second aperture is generally smaller than the first aperture for accommodating a range of twist-caps of a generally smaller size; and wherein the relatively straight segments of the first and second apertures are proximate to one another on the plate member.

17. An opener according to claim 16, further comprising a decorative housing mounted on the non-insertion face of the plate member to enclose the baffle members protruding therefrom.

18. An opener according to claim 17, wherein the housing member is centrally positioned along the length of the plate member and configured so as to serve as a gripping handle for the opener during use.

* * * * *